US008181700B2

(12) United States Patent
Baugh

(10) Patent No.: US 8,181,700 B2
(45) Date of Patent: May 22, 2012

(54) SYSTEM AND METHOD OF DISPLACING FLUIDS IN AN ANNULUS

(75) Inventor: Benton F. Baugh, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 363 days.

(21) Appl. No.: 12/456,681

(22) Filed: Jun. 22, 2009

(65) Prior Publication Data

US 2010/0319933 A1 Dec. 23, 2010

(51) Int. Cl.
*E21B 19/22* (2006.01)
*E21B 17/10* (2006.01)

(52) U.S. Cl. .... 166/77.1; 166/97.5; 166/312; 166/242.5

(58) Field of Classification Search ..... 166/77.1, 166/77.2, 88.4, 97.5, 90.1, 311, 312, 242.5, 166/242.1; 226/112, 158, 162
See application file for complete search history.

(56) References Cited

U.S. PATENT DOCUMENTS

| | | | | |
|---|---|---|---|---|
| 3,549,072 | A * | 12/1970 | Kinori | 226/112 |
| 4,848,480 | A * | 7/1989 | Titchener et al. | 166/385 |
| 5,469,925 | A * | 11/1995 | Mueller et al. | 175/61 |
| 5,927,405 | A * | 7/1999 | Monjure et al. | 166/384 |
| 6,315,046 | B1 * | 11/2001 | Jack et al. | 166/312 |
| 6,974,341 | B2 * | 12/2005 | Jennings | 439/191 |
| 7,650,941 | B2 * | 1/2010 | Zachry | 166/312 |
| 7,770,653 | B2 * | 8/2010 | Hill et al. | 166/379 |
| 2007/0175642 | A1 * | 8/2007 | Shampine et al. | 166/382 |

* cited by examiner

*Primary Examiner* — Kenneth L Thompson
(74) *Attorney, Agent, or Firm* — Bracewell & Giuliani LLP

(57) ABSTRACT

The method of displacing fluids in the annulus between pressurized casing strings inside an active oil or gas well by providing a controlled turndown insert and guides then inserting and retrieving a flexible hose without it folding or buckling while being pushed or pulled through a wellhead system orifice with relatively sharp edges at the annulus opening where the hose must make a 90 degree turn from horizontal to vertical within a short radius without cutting, crimping or tearing the hose then seating and holding the hose while fluids are injected, all the while providing protection against well blow out or other pressure problems.

29 Claims, 18 Drawing Sheets

SYSTEM AND METHOD OF DISPLACING FLUIDS IN AN ANNULUS

CROSS-REFERENCE TO RELATED APPLICATIONS

N/A

STATEMENT REGARDING FEDERALLY SPONSORED RESEARCH OR DEVELOPMENT

N/A

INCORPORATION-BY-REFERENCE OF MATERIAL SUBMITTED ON A COMPACT DISK

N/A

BACKGROUND OF THE INVENTION

The field of this invention is that of inserting and retrieving several thousand feet of a flexible hose from a horizontal opening into the narrow annulus between casing strings of oil or gas wells. The hose will be inserted through the wellhead outlet bore that has relatively sharp corners at the annulus opening. The hose bend radius required at the annulus opening where the casing annulus and the wellhead outlet bore intersect is a very tight turn requiring the hose to turn from horizontal to vertical in the distance of approximately 1.25 inches. When hoses are inserted they are cut or crimped by the sharp corners at the annulus opening (intersection) and are rendered useless and/or can not be retrieved because they will be severed by the sharp corners. The hose may be attached to a specialized weight system to facilitate its downward movement once inside the annulus. The hose can be fitted with a check valve to eliminate the back flow of pressure.

Once inserted and positioned in the annulus the hose can inject anti-freeze type chemicals to eliminate hydrate formation or inject designed weight fluids to produce the desired hydrostatic head pressure to reduce the influx of unwanted fluids from outside the casing. Then once the job is complete the hose can not be recovered however, it would be desirable to recover the hose for use else where if possible.

Oil or gas wells can encounter problems with the formation of hydrates (a form of ice) in the casing annulus. The formation of hydrates in a confined space can generate a pressure of several thousand pounds per square inch. The casing annulus is a confined space therefore the expansion pressure encountered during the formation of hydrates can cause the internal casing to collapse or the external casing to burst. Both forms of damage are difficult and costly to repair.

Oil or gas wells can encounter problems when the casing develops a hole or the cement job becomes porous and unwanted fluids begin to infiltrate and pressurize the casing annulus. This infiltration results when an infiltration path is created and the casing annulus contains a lower pressure than the outside reservoir or other casing strings.

BRIEF SUMMARY OF THE INVENTION

A technique is provided for inserting a hose through a wellhead outlet bore into a casing annulus while protecting the hose from the sharp corners of the wellhead outlet bore.

Another technique is provided for retrieving a hose after it has been inserted into a casing annulus while protecting the hose form the sharp corners of the wellhead outlet bore.

Yet another technique is provided for inserting a hose into a pressurized casing annulus and inject fluids without having to relieve the annulus pressure.

DETAILED DESCRIPTION OF THE INVENTION

Figure 1:
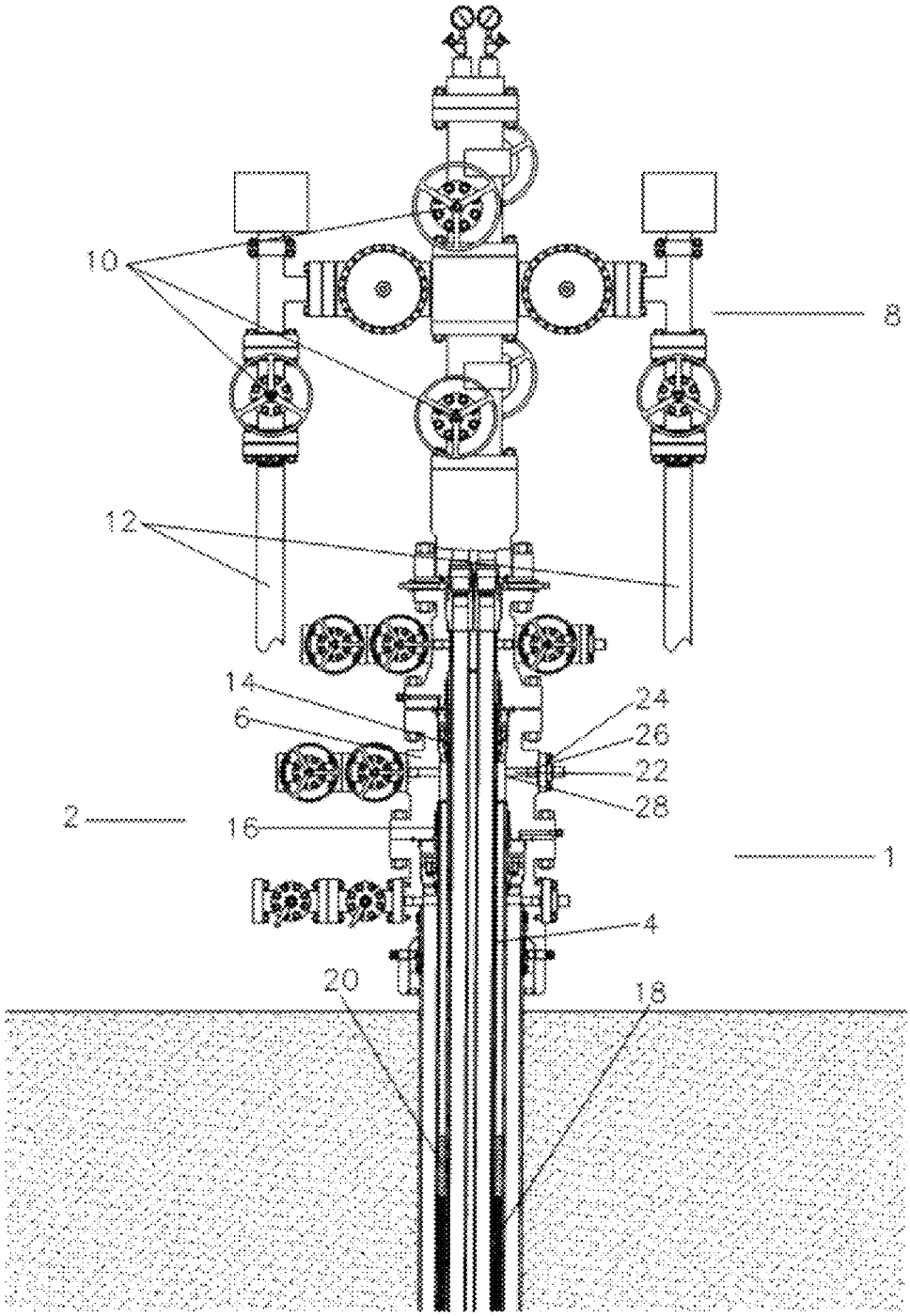
FIG. 1 is a diagram showing a traditional wellhead assembly system with three casing strings hung in the wellhead system and it provides access to two casing annuli through wellhead outlet bores.

FIG. 1 is a drawing showing an oil or gas well 1 being produced through a traditional surface wellhead system 2 with a casing string 4 hung in a wellhead spool 6. Atop the wellhead system 2 is a Christmas tree 8 which contains valves 10 that operate the various well functions including delivery of oil or gas into the pipeline(s) 12. Casing hanger 14 supports the inner casing string 4 inside a wellhead spool 6 and create a seal at the top of the corresponding outer casing annulus 16. Casing string 4 has been cemented 18 into place and sometimes unwanted fluids 20 enter the casing annulus 16 through porous cement 18 or a leaking casing string 4. It is often necessary to enter a casing annulus 16 to displace or neutralize the unwanted fluids 20. Access to a casing annulus 16 is made through a wellhead outlet bore 22 after removing the blind flange 24 and conventional VR plug 26. The intersection of the wellhead outlet bore 22 and the casing annulus 16 produces a relatively sharp corner or first radius 28 that makes it difficult to insert or retrieve any apparatus through the wellhead outlet bore 22 and into the casing annulus 16 to displace or neutralize the unwanted fluids 20.

Figure 2:
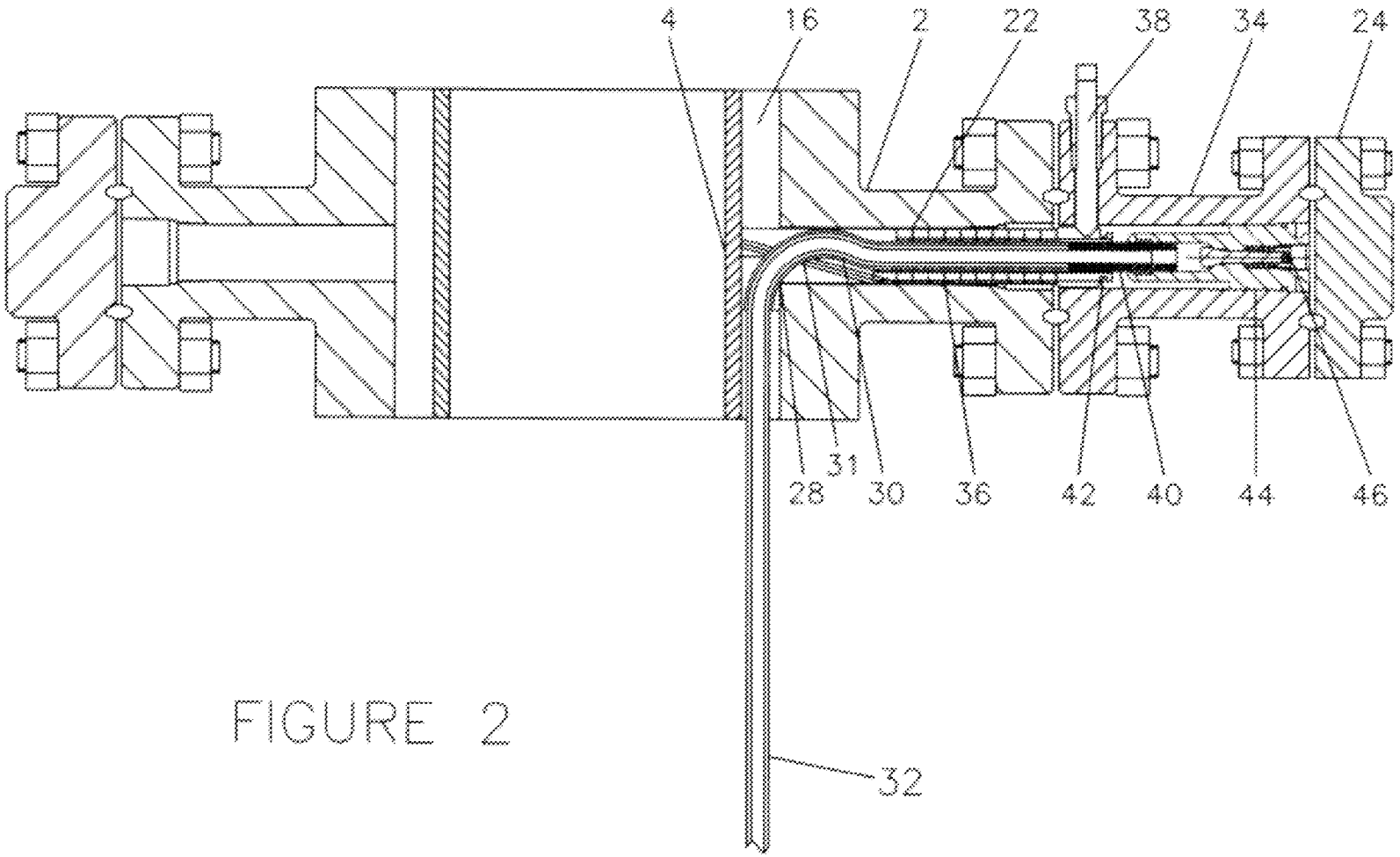
FIG. 2 is a portion of the half section of the wellhead of FIG. 1 showing a hose installed in accordance with an exemplary embodiment of the present technique.

FIG. 2, shows the fully installed position of the turndown 30 having a second radius 31 and the media injection hose 32 in the wellhead outlet bore 22 with other necessary parts installed by the methods of this invention. The turndown 30 is necessary because the wellhead outlet bore 22 has a relatively sharp corner 28 that can cut or crimp the hose 32. This half section shows the approximately 1.25 inch wide casing annulus 16, the casing string 4, the wellhead system 2 and the wellhead outlet bore 22. The adapter spool 34 has been attached to the wellhead system 2. The turndown 30 with the appropriate number of turndown spacer rings 36 has been installed through the adapter spool 34, the wellhead outlet bore 22 and into the casing annulus 16. The turndown 30 has been locked into position by the orientation screw 38 in the adapter spool 34. The landing coupling 40 has been attached to the hose 32 and has been seated on the castellated nest 42 in the turndown 30. The injection VR plug 44 which contains a VR check valve 46 has been screwed into the adapter spool 34 and a blind flange 24 has been installed onto the adapter spool 34. Workers can now come and remove the blind flange 24 from the adapter spool 34 and install fluid injection tooling at the VR check valve 46 to inject fluids through the hose 32 into the casing annulus 16.

Figure 3:
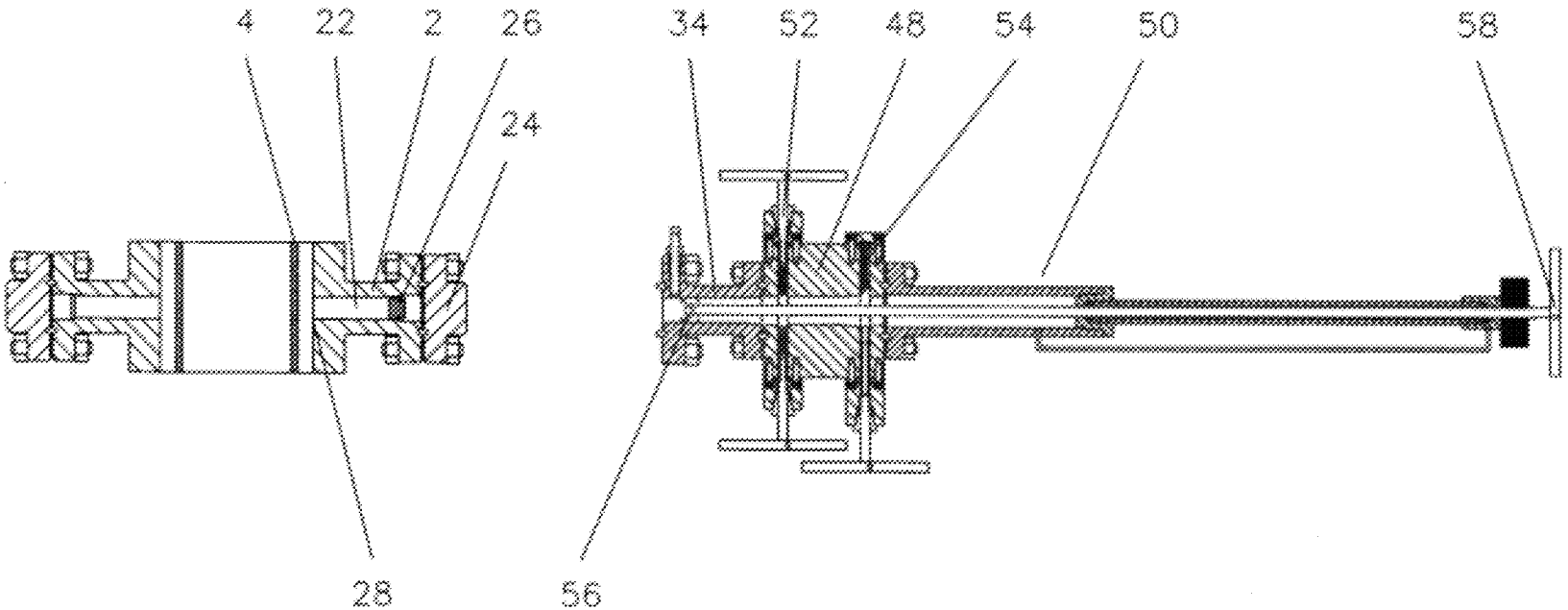
FIG. 3 shows the portion of the half section as seen in FIG. 2 before the hose is installed and a half section of the tool assembly which will be used to remove the conventional valve removal (VR) plug from the outlet bore.

FIG. 3, shows the installation starting point with initial setup. A conventional VR plug 26 is in place in the wellhead outlet bore 22 and the blind flange 24 is attached to the wellhead system 2. The adapter spool 34, the pressure control assembly 48, and the running tool 50 have been assembled together and are ready to be installed on the wellhead system 2 once the blind flange 24 is removed. The adapter spool 34 will remain in place when the job is completed and is designed to hold the turndown 30 in place in the wellhead outlet bore 22 and provide a seat for the injection VR plug 44 with its VR check valve 46. The pressure control assembly 48 contains the BOP 52 system which provides pressure control when a hose 32 passes through the pressure control assembly 48 it also contains the gate valve 54 which can be opened or closed to provide protection against normal well pressures as various operational tooling is installed or removed or it can be used during emergencies to cut the hose 32 and provide pressure control. The running tool 50 contains the conventional VR plug removal adaptor 56 and the removal adaptor handle 58.

Figure 4:
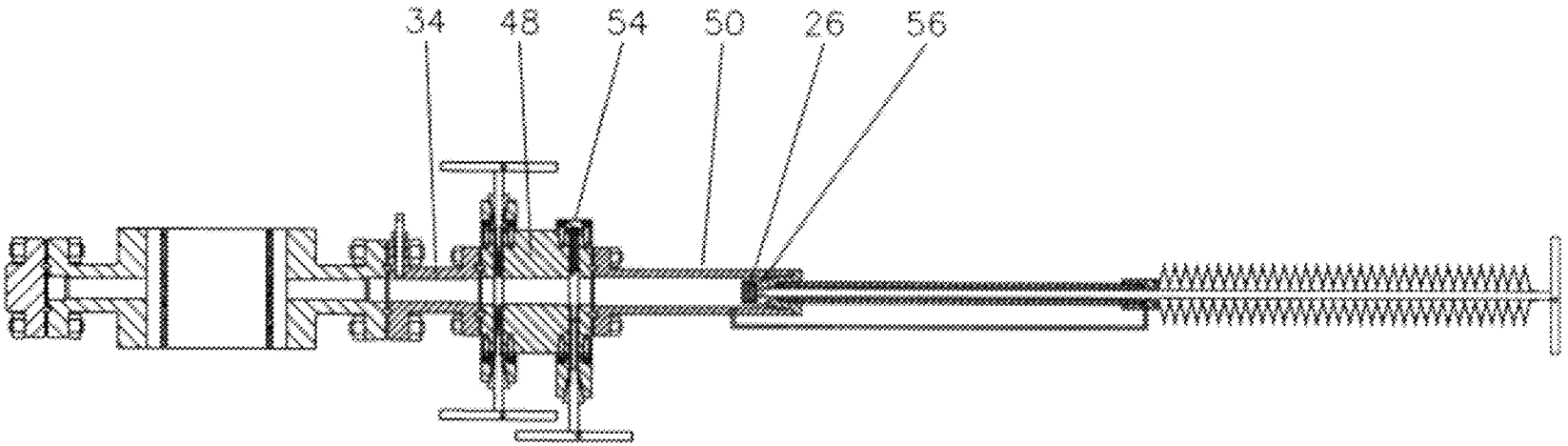
FIG. 4 shows the tool assembly attached to the outlet bore and the conventional VR plug removed.

FIG. 4 is a half section showing the blind flange 24 removed and the adapter spool 34, the pressure control assembly 48 and the running tool 50 attached to the wellhead system 2. The conventional VR plug 26 has been removed and is in the conventional VR plug removal adaptor 56 and the gate valve 54 is open.

Figure 5:
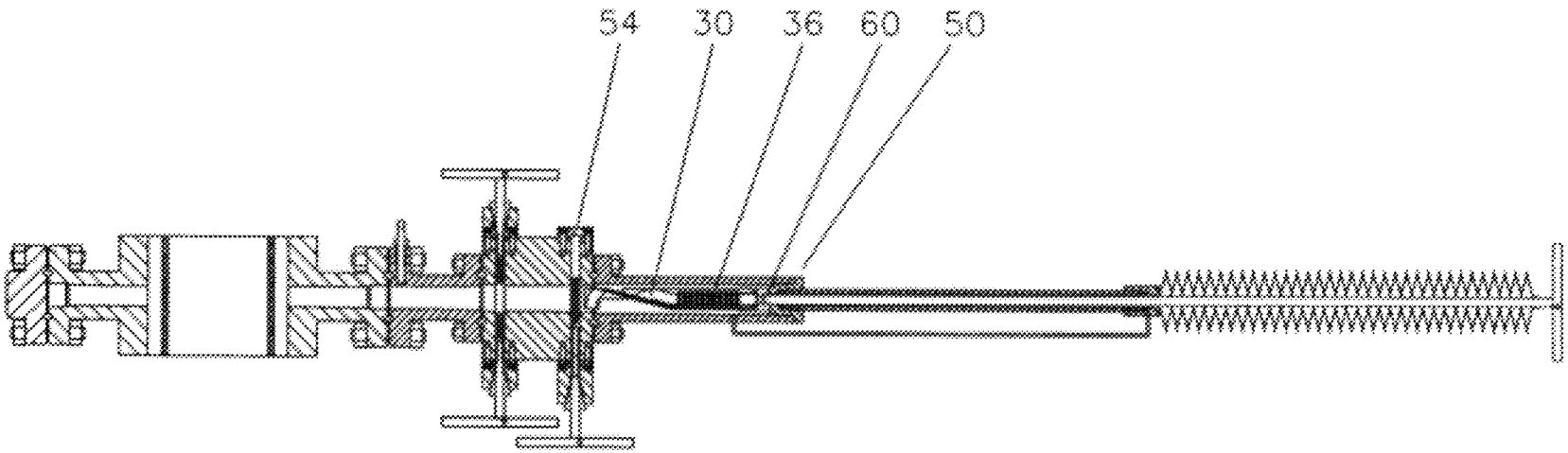
FIG. 5 is a half section showing the turndown being gripped by the running tool and ready for the gate valve to be opened so the turndown can be moved forward to the casing wall.

FIG. 5 is a half section showing the turndown 30, with the desired number of turndown spacer rings 36 added to allow the turndown 30 to be properly positioned and locked in place. The turndown 30 has been inserted into the running tool 50 and engaged by the injection VR plug removal adaptor 60. The turndown 30 has a detent device holding it in the insertion position and is ready to be run into place when the gate valve 54 is opened.

Figure 6:
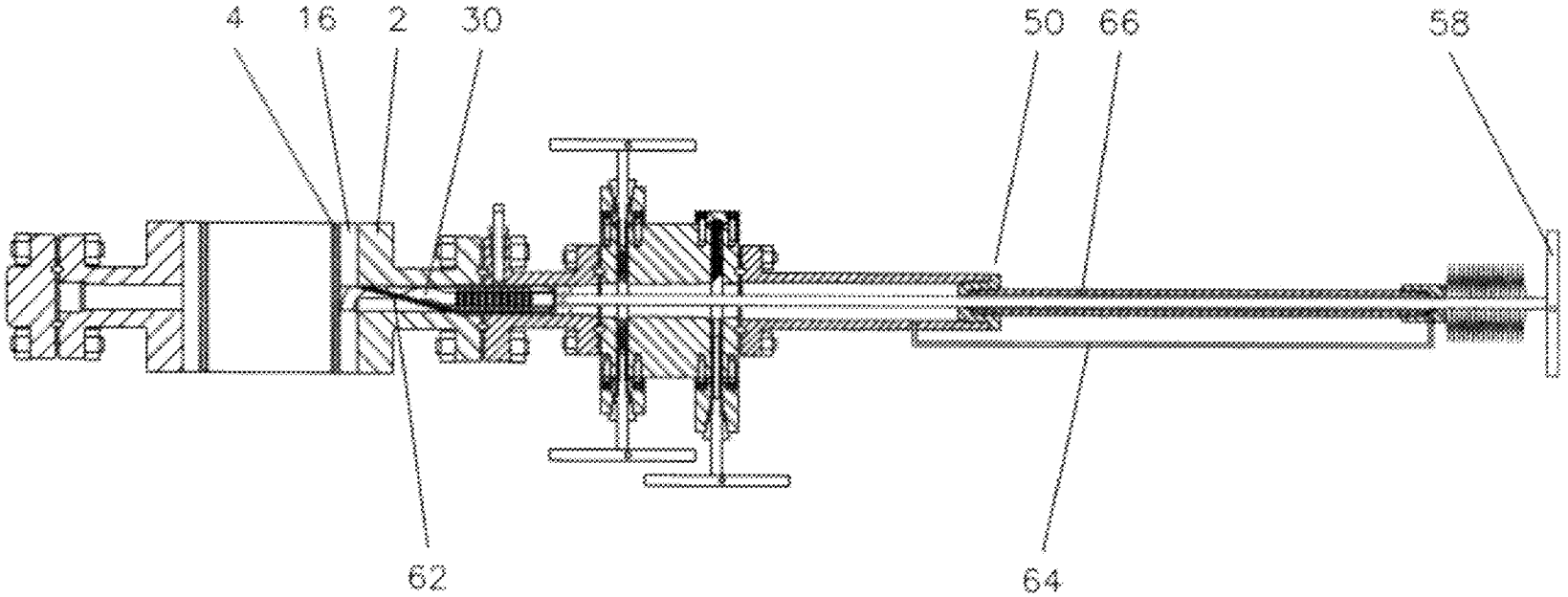
FIG. 6 is a half section showing the turndown initiating contact with the casing wall.

FIG. 6 is a half section showing the turndown 30, held in the insertion position by detent device and initiating contact with the casing string 4. The two parts of the turndown 30 are joined along the t-slot contact surface 62. The pressure balancing bypass line 64 in the running tool 50 allows the pressure to equalize between the casing annulus 16 and the running tool guide cylinder 66 so the operator does not have to push the tool against the annulus pressure.

Figure 7:
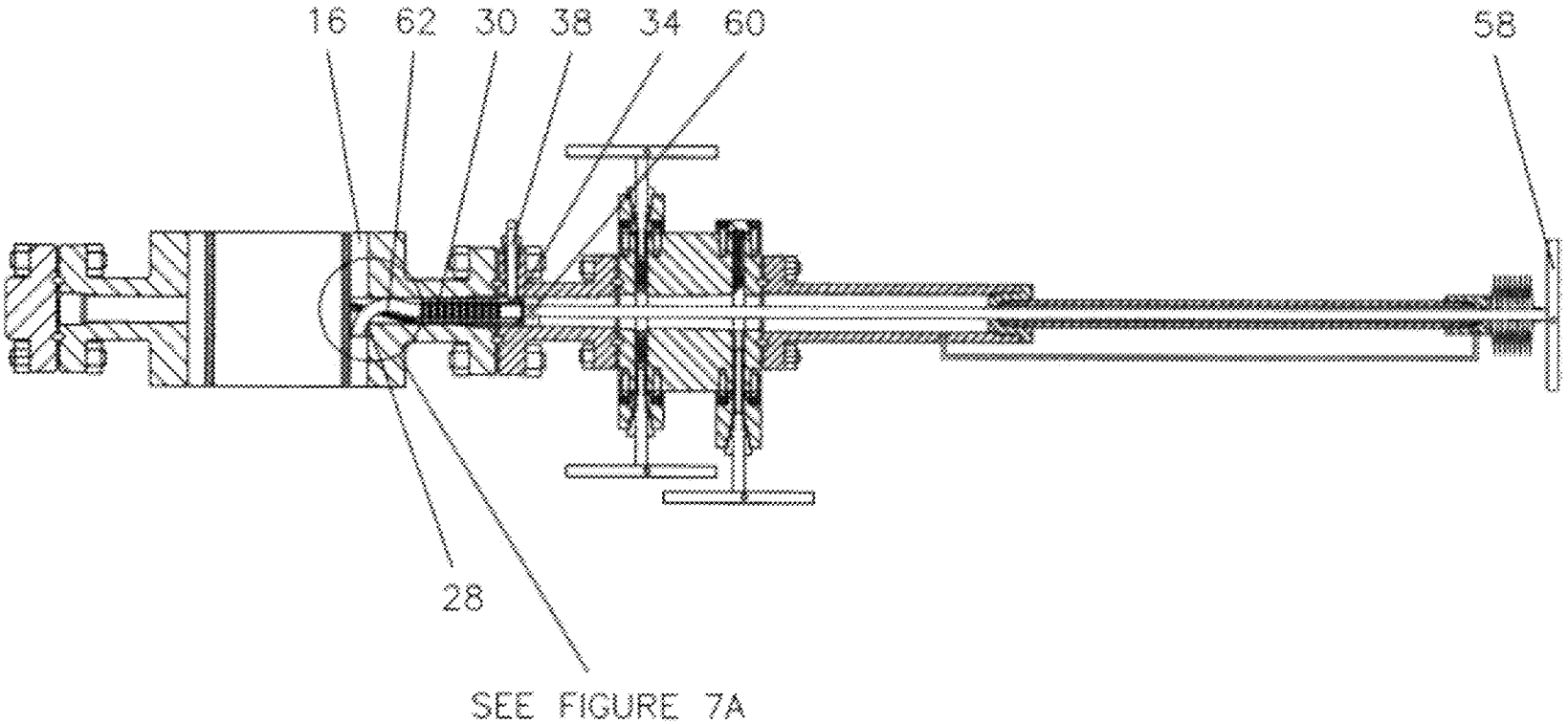
FIG. 7 is a half section showing the turndown pushed fully into position in the casing annulus and the orientation screw set.

FIG. 7 is a half section showing the turndown 30 pushed into position in the casing annulus 16 and the orientation screw 38 set. The detent device has been released or sheared and the two parts of the turndown 30 have been moved along their t-slot contact surface 62 until the turndown 30 is fully installed providing an opening to insert and remove the hose past the sharp corner 28 in the casing annulus 16. When the turndown 30 has been oriented and positioned properly in the casing annulus 16 the orientation screw 38 is then tightened to lock the turndown 30 in place in the adaptor spool 34. The removal adaptor handle 58 is then rotated 90 degrees counter clockwise so the injection VR plug removal adaptor 60 will release from the turndown 30 then the injection VR plug removal adaptor 60 can be retracted.

Figure 7A:
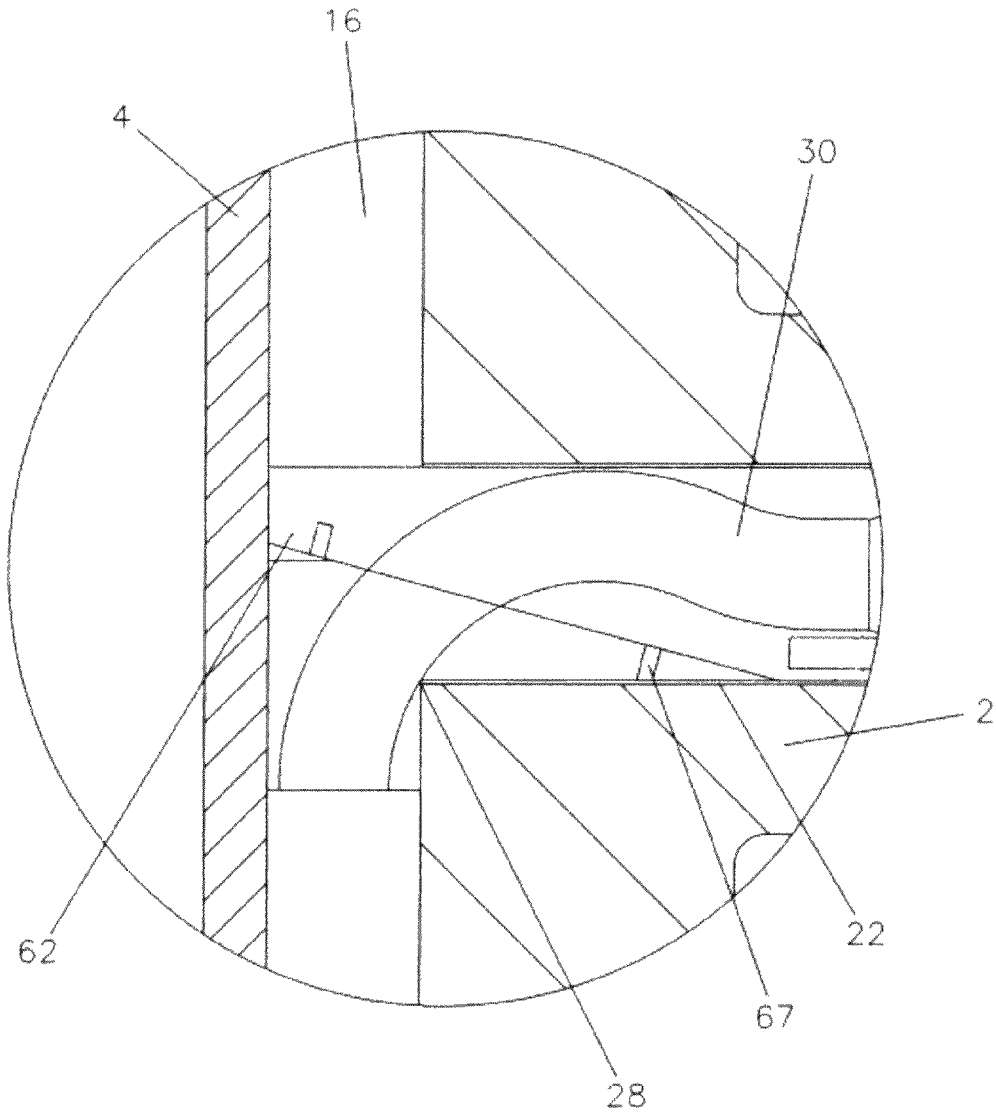
FIG. 7*a* is a partial section showing the turndown pushed fully into position in the casing annulus past the sharp corner.

FIG. 7*a*. is a partial section showing the turndown 30 pushed into position in the casing annulus 16 the detent device 67 has been released or sheared and the two parts of the turndown 30 have been moved along their t-slot contact surface 62 until the turndown 30 is fully installed providing an opening to insert and remove the hose past the sharp corner 28 in the casing annulus 16.

Figure 8:
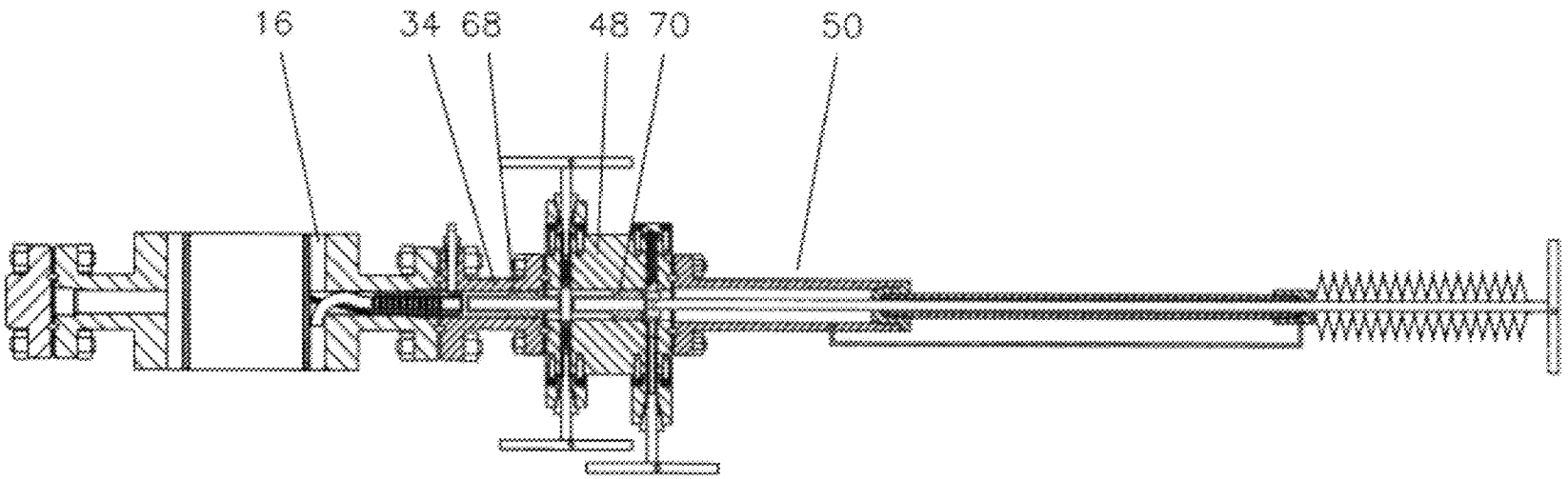
FIG. 8 is a half section showing the bushings installed to prevent buckling in the small diameter hose which will be inserted.

FIG. 8 is a half section showing the inner guide bushing 68 installed into the adaptor spool 34 and the outer guide bushing 70 being installed into the pressure control assembly 48 by the running tool 50. These will prevent the hose from buckling as it is pushed into the casing annulus 16.

Figure 9:
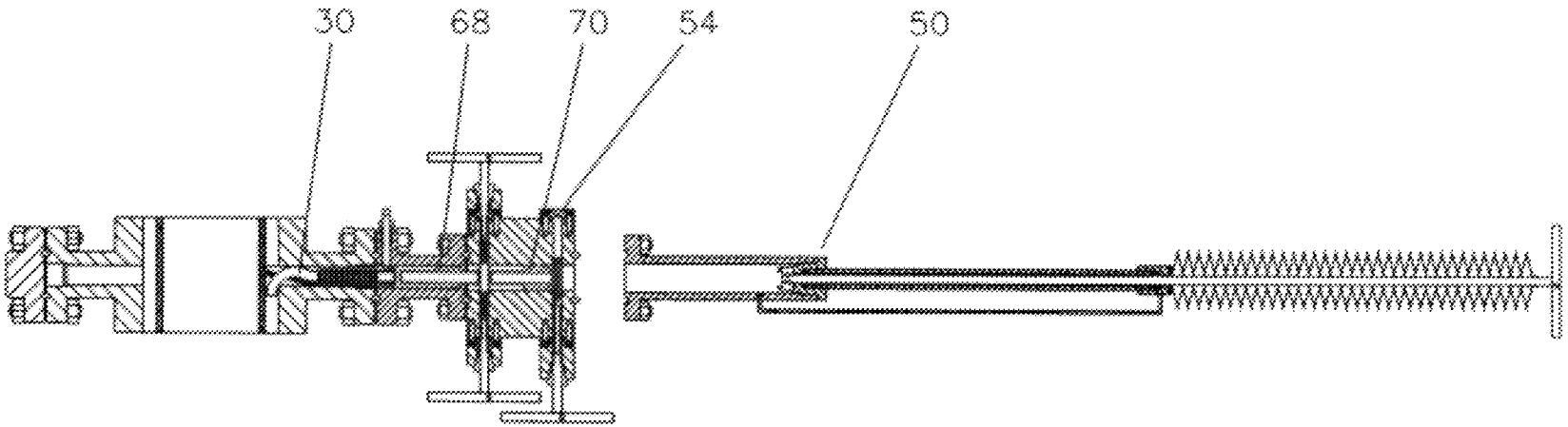
FIG. 9 is a half section showing the turndown and guide bushings installed, the gate valve is closed and the running tool has been removed.

FIG. 9 is a half section showing the turndown 30 and guide bushings 68 & 70 installed, the gate valve 54 is closed and the running tool 50 has been removed.

Figure 10:
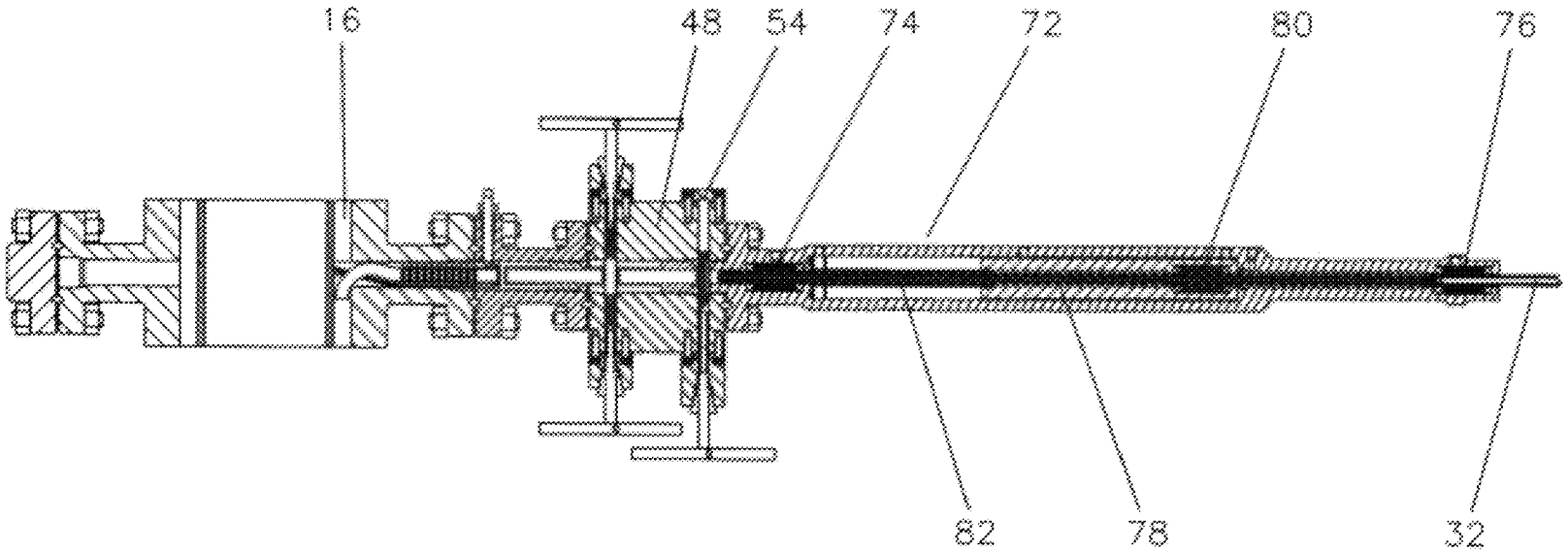
FIG. 10 is a half section showing the snubber assembly attached to the pressure control assembly containing an articulated weight device attached to the hose.

FIG. 10 is a half section showing the snubber assembly 72 attached to the pressure control assembly 48. The snubber assembly 72 has two fixed position pressure protection gripper seals, the stationary seal 74 and the rear seal 76. The snubber assembly 72 contains the articulated weight device 78 attached to the leading end of the hose 32. The articulated weight device 78 and hose 32 will be fed into the pressurized casing annulus 16 by the traveling seal 80, a movable pressure protection gripper seal (shown in the outward stroke—grip position) which is hydraulically activated to slide back and forth with a 12 inch stroke as it grips and releases the hose 32 as it is fed into or removed from the casing annulus 16. The traveling seal 80 slides back and forth around the hose guide 82 which keeps the hose 32 from buckling inside the snubber assembly 72 as it is being inserted in to the pressurized casing annulus 16.

Figure 11:
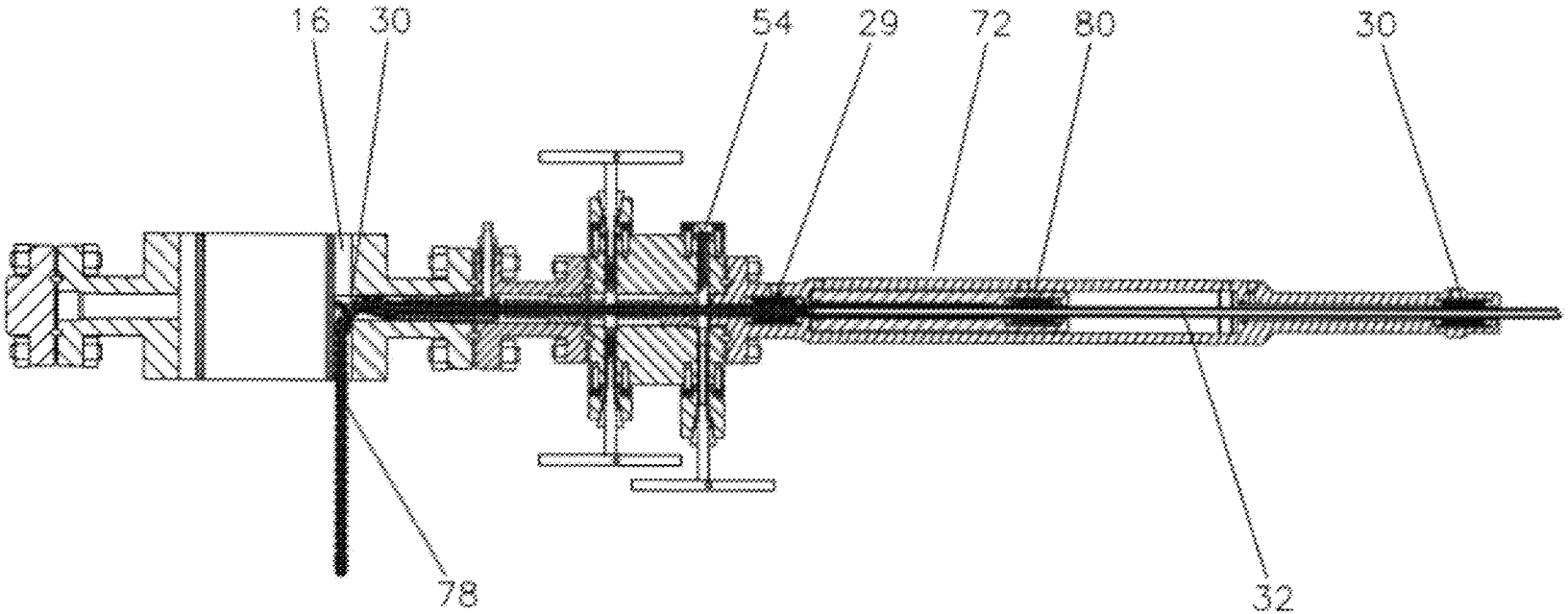
FIG. 11 is a half section showing the gate valve open and the snubber device working to insert the articulated weight device through the Turndown and into the casing annulus.

FIG. 11 is a half section showing the gate valve 54 open and the snubber assembly 72 working to insert the articulated weight device 78 through the turndown 30 and into the casing annulus 16. The traveling seal 80 in the inward stroke (release position).

Figure 12:
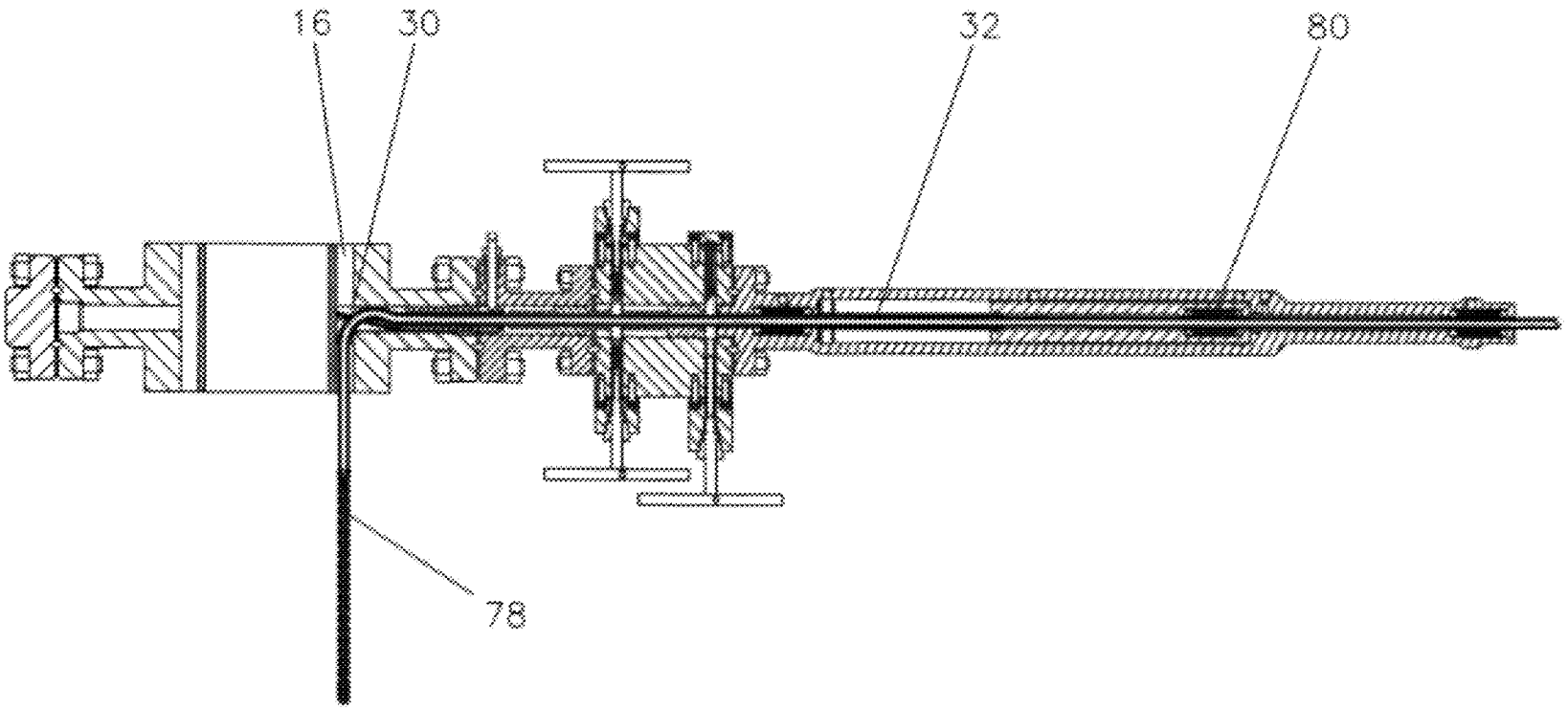
FIG. 12 is a half section showing the tooling conditions under which most hose injection will occur, with the snubber device in the outward stroke and the hose being fed to the desired depth or retrieved through the turndown.

FIG. 12 is a half section showing the same detail as FIG. 11 only showing the traveling seal 80 in the outward stroke and the hose 32 being fed to the desired depth or retrieved through the turndown 30.

Figure 13:
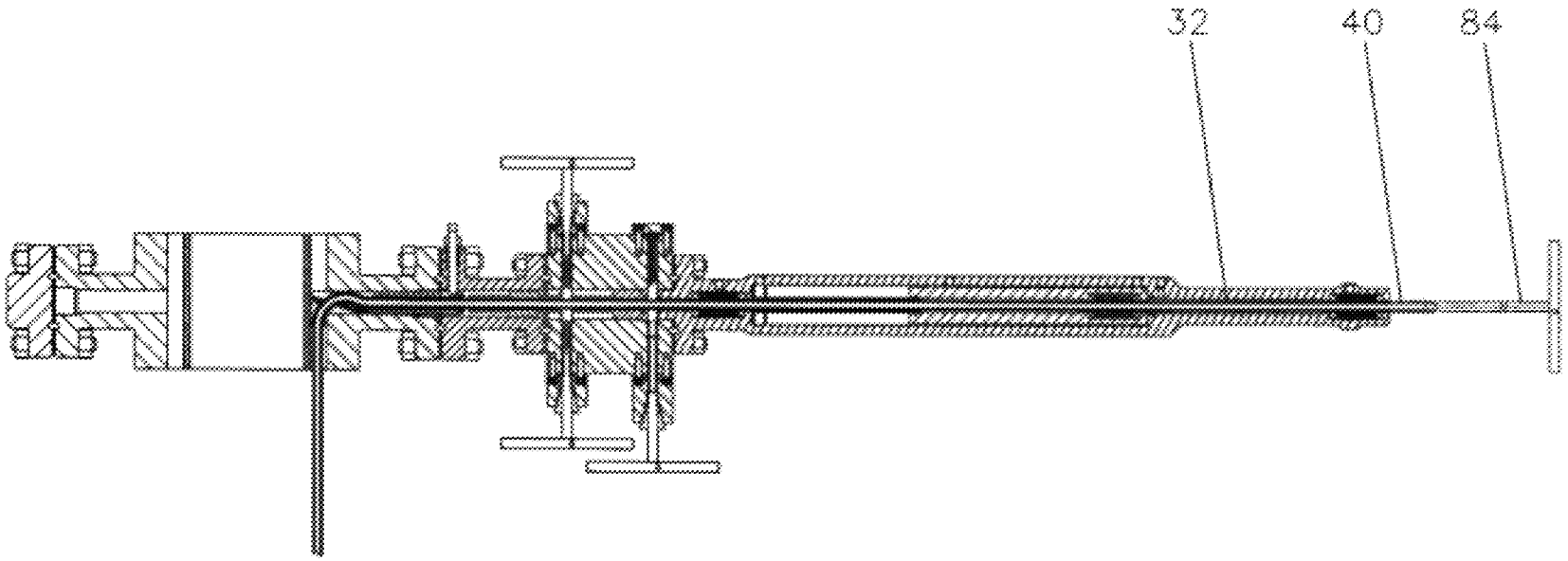
FIG. 13 is a half section showing the hose landing coupling with one end attached to the end of the hose and the other end attached to the landing device.

FIG. 13 is a half section showing the landing coupling 40 with one end attached to the hose 32 and the other end attached to the landing device 84.

Figure 14:
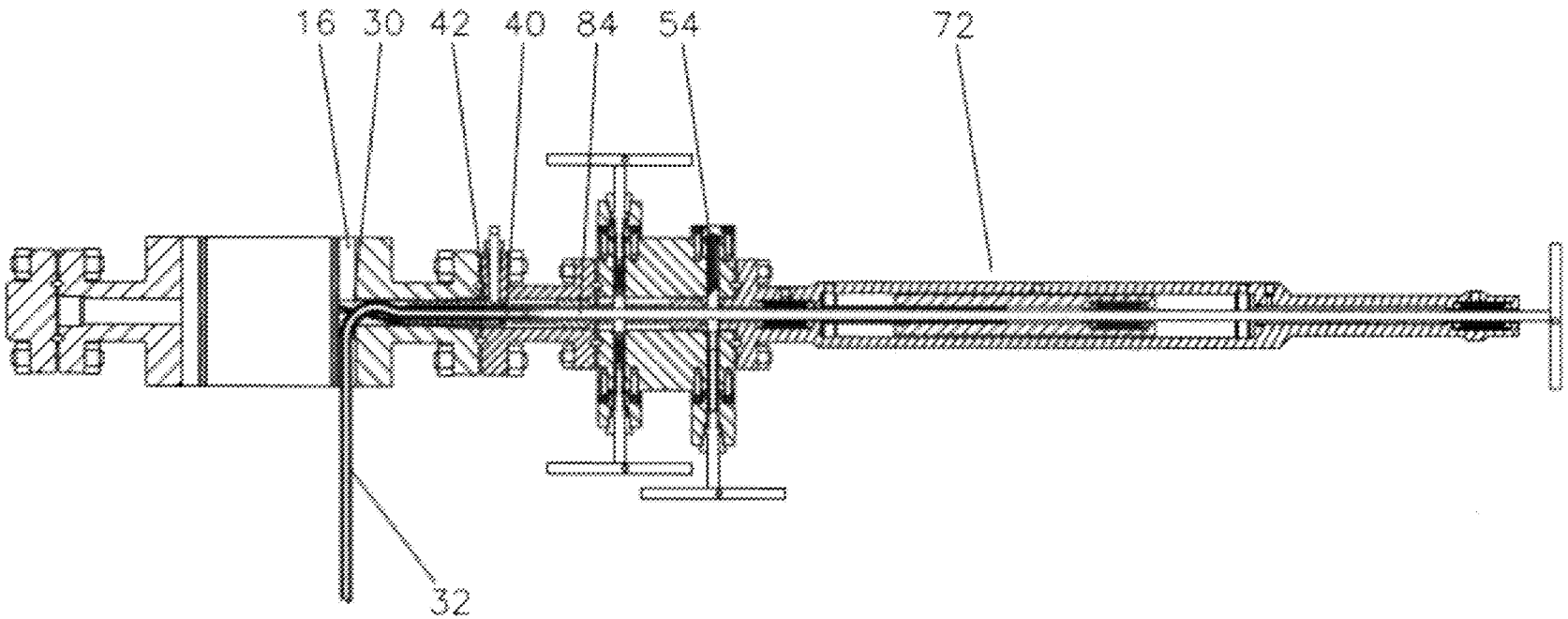
FIG. 14 is a half section showing the hose landing coupling seated on the castellated shoulder in the turndown.

FIG. 14 is a half section showing the landing coupling 40 seated in the castellated nest 42 in the turndown 30. The snubber assembly 72 has fed it into position and the landing device 84 can now be disconnected by rotation and retracted into the snubber assembly 72. The undamaged hose 32 with the landing coupling 40 is now being held in its operating position ready to transmit fluids into the casing annulus 16.

Figure 15:
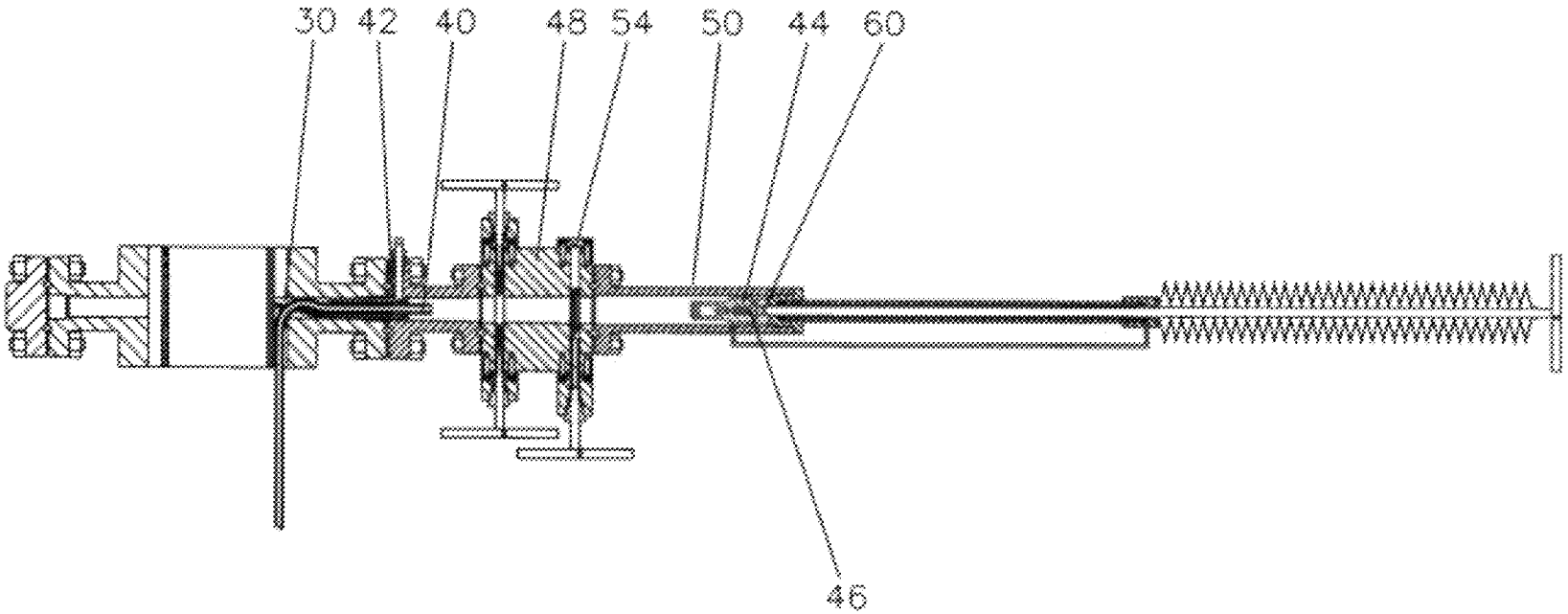
FIG. 15 is a half section showing the hose landing coupling seated on the castellated shoulder in the turndown, the bushings removed, and the running tool installed with an injection VR plug.

FIG. 15 is a half section showing the landing coupling 40 seated on the castellated nest 42 in the turndown 30. The running tool 50 has been reconnected to the pressure control assembly 48 and the injection VR plug removal adaptor 60 has engaged and removed the outer guide bushing 70 and the inner guide bushing 68. The gate valve 54 is closed and the injection VR plug removal adaptor 60 has engaged the injection VR plug 44 for installation. The injection VR plug 44 contains a VR check valve 46.

Figure 16:
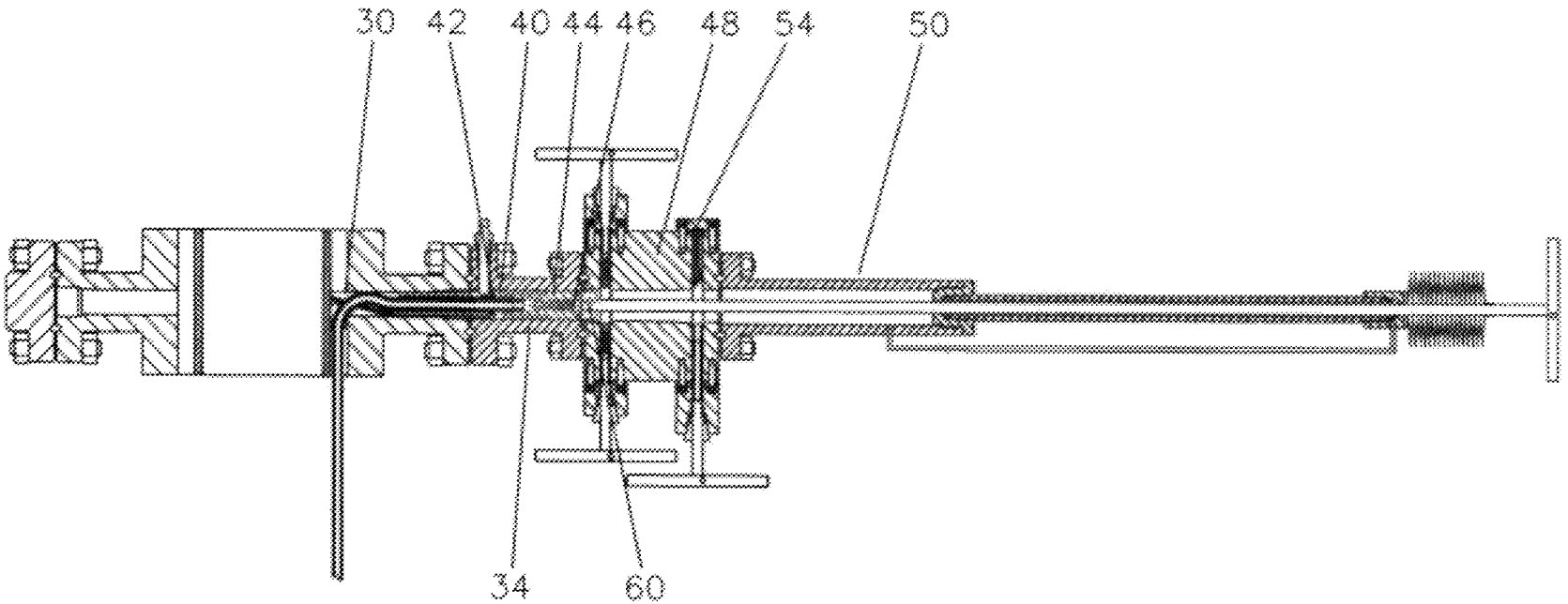
FIG. 16 is a half section showing the injection VR plug landed.

FIG. 16 is a half section showing the landing coupling 40 seated on the castellated nest 42 in the turndown 30, the gate valve 54 open and the running tool 50 has installed the injection VR plug 44 in the adapter spool 34. The injection VR plug removal adaptor 60 is ready to disconnect from the injection VR plug 44. The running tool 50 can be disconnected, the pressure control assembly 48 can be removed and the blind flange can be installed on the adapter spool 34.

Figure 17:
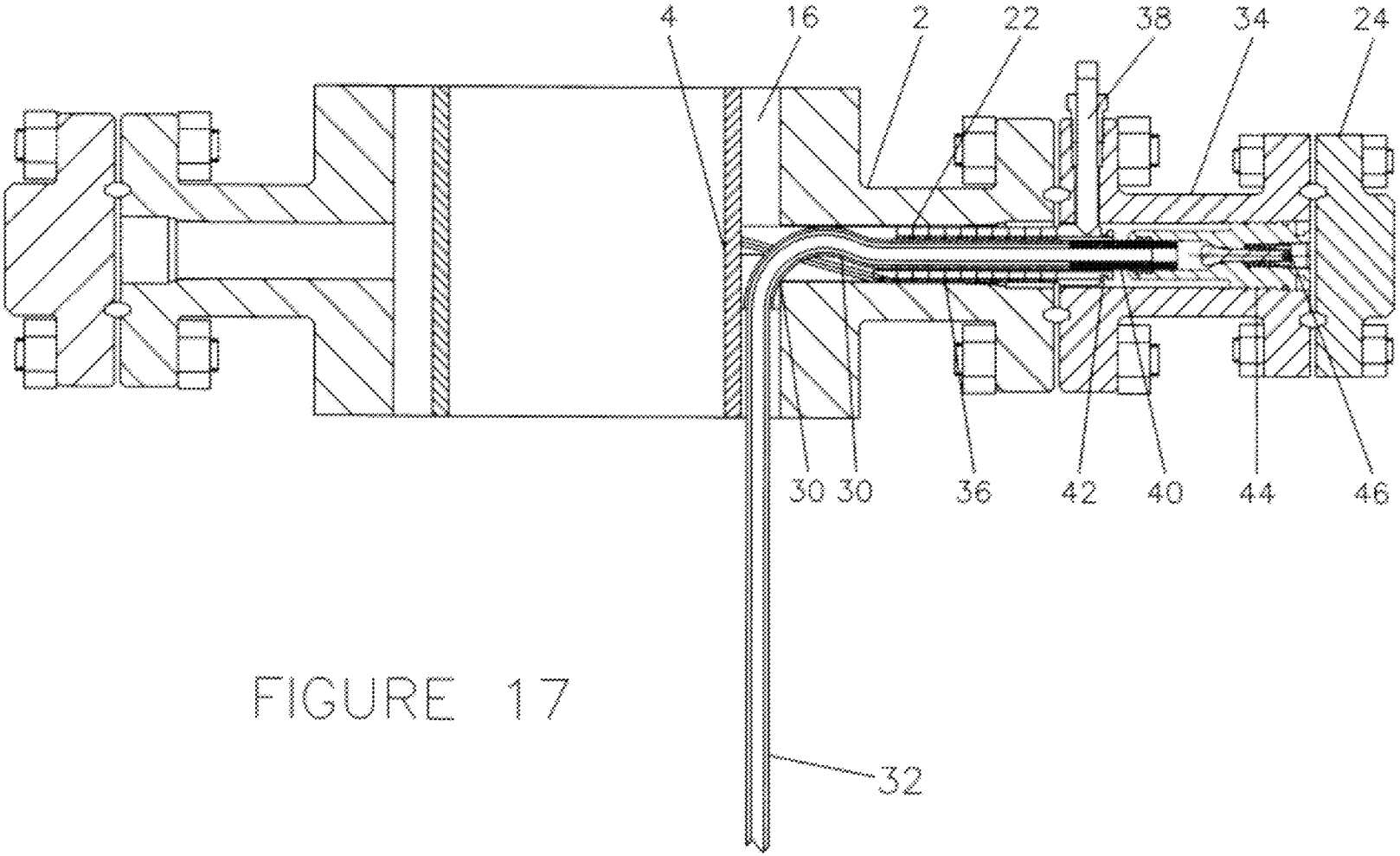
FIG. 17 is a half section showing the completed assembly with the tools removed and a blind flange added.

FIG. 17 is a half section showing the final position of the turndown 30 with hose 32 and landing coupling 40 seated on the castellated nest 42, the injection VR plug 44 with VR check valve 46 is installed and the blind flange 24 is in place. This turndown 30 is necessary because the wellhead outlet bore 22 has a sharp corner 28 that can cut or crimp hoses inserted without the turndown 30. This diagram shows the casing annulus 16, the casing string 4, the wellhead system 2 and the wellhead outlet bore 22. The adapter spool 34 which includes the orientation screw 38 has been attached to the wellhead system 2. The turndown 30 with the appropriate number of turndown spacer rings 36 has been installed in the casing annulus 16. The turndown 30 has been locked into position by the orientation screw 38 in the adapter spool 34. The landing coupling 40 has been attached to the hose 32 and has been seated on the castellated nest 42 in the turndown 30. The injection VR plug 44 which contains a VR check valve 46 has been screwed into the adapter spool 34 and a blind flange 24 has been installed onto the adapter spool 34. Workers can now come and remove the blind flange 24 from the adapter spool 34 and attach a tool to inject fluids through the hose 32 into the casing annulus 16.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

The invention claimed is:

1. A method of displacing fluids in an annulus between casing strings of an active oil or gas well, the well having a wellhead with an outlet bore extending perpendicular to a longitudinal axis of the wellhead, the method comprising:

providing a hose for injection into said annulus through the outlet bore of the wellhead, wherein an intersection of said outlet bore and said wellhead has a corner with a first radius which might damage said hose;

inserting a turndown into said outlet bore from an outer end of said outlet bore and positioning an inner end of said turndown in said annulus, the turndown overlapping said corner with a surface with a second radius larger than said first radius;

inserting said hose through said outlet bore, along said second radius of said turndown, and down into said annulus; and pumping fluid through said hose into said annulus to displace at least a portion of said fluids in said annulus out of said annulus.

2. The invention of claim 1, further comprising engaging said hose with a moving gripper and moving said gripper relative to said wellhead to move said hose.

3. The invention of claim 2, further comprising said moving gripper seals on the outside diameter of said hose when said moving gripper is gripping said hose.

4. The invention of claim 2, further comprising providing a stationary gripper that is stationary relative to said wellhead to hold said hose when said moving gripper is released and is travelling to re-grip said hose at another location.

5. The invention of claim 4, further comprising said stationary gripper seals on the outside of said hose when said stationary gripper is gripping said hose.

6. The invention of claim 1, further comprising providing a landing coupling on said hose which is landed in and is supported by said turndown.

7. A method of displacing fluids in an annulus between casing strings of an active oil or gas well, the method comprising:

providing a hose for injection into said annulus through an outlet bore of a wellhead, wherein an intersection of said outlet bore and said wellhead has a corner with a first radius which might damage said hose;

placing a turndown into said outlet bore which overlaps said corner with a surface with a second radius larger than said first radius, said second radius being larger than the diameter of said outlet bore through which it is installed, and providing a part of said second radius in a first section and a part of said second radius in a second section which are moveable relative to one another;

inserting said hose through said outlet bore, along said second radius of said turndown, and down into said annulus; and pumping fluid through said hose into said annulus to displace at least a portion of said fluids in said annulus out of said annulus.

8. The invention of claim 7, further comprising engaging said hose with a moving gripper and moving said moving gripper relative to said wellhead to move said hose.

9. The invention of claim 8, wherein said moving gripper seals on the outside diameter of said hose when said moving gripper is gripping said hose.

10. The invention of claim 8, further comprising providing a stationary gripper that is stationary relative to said wellhead to hold said hose when said moving gripper is released and is travelling to re-grip said hose at another location.

11. The invention of claim 10, wherein said stationary gripper seals on the outside of said hose when said stationary gripper is gripping said hose.

12. The invention of claim 7, further comprising providing a landing coupling on said hose which is landed in and is supported by said turndown.

13. The invention of claim 7, further comprising controlling the movement of said first section relative to said second section with a T-Slot.

14. The invention of claim 7, further comprising preventing said movement of said first section relative to said second section using one or more shear pins.

15. A method of displacing fluids in an annulus between casing strings of an active oil or gas well comprising:

providing a hose for injection into said annulus through an outlet bore on a wellhead wherein an intersection of said outlet bore and said wellhead has a corner with a first radius which might damage said hose;

placing a turndown into said outlet bore which overlaps said corner with a surface with a second radius larger than said first radius, said second radius being larger than the diameter of said outlet bore through which it is installed, providing a surface of a third radius larger than said second radius by at least the diameter of said hose to be injected through said turndown;

inserting said hose through said outlet bore, between said second radius of said turndown and said third radius of said turndown, and down into said annulus; and pumping fluid through said hose into said annulus to displace at least a portion of said fluids in said annulus out of said annulus.

16. The invention of claim 15, further comprising engaging said hose with a moving gripper and moving said gripper relative to said wellhead to move said hose.

17. The invention of claim 16, wherein said moving gripper seals on the outside diameter of said hose when said moving gripper is gripping said hose.

18. The invention of claim 16, further comprising providing a stationary gripper that is stationary relative to said wellhead to hold said hose when said moving gripper is released and is travelling to re-grip said hose at another location.

19. The invention of claim 18, wherein said stationary gripper seals on the outside of said hose when said stationary gripper is gripping said hose.

20. The invention of claim 15, further comprising providing a landing coupling on said hose which is landed in and is supported by said turndown.

21. The invention of claim 20, further comprising providing a part of said second radius in a first section and a part of said second radius in a second section which are moveable relative to one another.

22. The invention of claim 21, further comprising controlling the movement of said first section relative to said second section with a T-Slot.

23. The invention of claim 22, further comprising preventing said movement of said first section relative to said second section using one or more shear pins.

24. A method of displacing fluids in an annulus between casing strings of an active oil or gas well comprising:

providing a hose for injection into said annulus through an outlet bore on a wellhead wherein an intersection of said outlet bore and said wellhead has a corner with a first radius which might damage said hose;

placing a turndown into said outlet bore which overlaps said corner with a surface with a second radius larger than said first radius, and providing a part of said second radius in a first section and a part of said second radius in a second section which are moveable relative to one another;

engaging said hose with a moving gripper and moving said gripper relative to said wellhead to move said hose through said outlet bore and said turndown into said annulus;

providing a stationary gripper that is stationary relative to said wellhead to hold said hose when said moving gripper is released and is travelling to re-grip said hose at another location; and pumping fluid through said hose into said annulus to displace at least a portion of said fluids in said annulus out of said annulus.

25. The invention of claim 24, wherein said moving gripper seals on the outside diameter of said hose when said moving gripper is gripping said hose.

26. The invention of claim 24, wherein said stationary gripper seals on the outside of said hose when said stationary gripper is gripping said hose.

27. The invention of claim 24, wherein said second radius being larger than a diameter of said outlet bore through which it is installed.

28. The invention of claim 24, further comprising controlling the movement of said first section relative to said second section with a T-Slot.

29. The invention of claim 24, further comprising preventing said movement of said first section relative to said second section using one or more shear pins.

* * * * *